US006253744B1

(12) United States Patent
Saruwatari et al.

(10) Patent No.: US 6,253,744 B1
(45) Date of Patent: Jul. 3, 2001

(54) METHOD AND APPARATUS FOR CONTROLLING FUEL VAPOR, METHOD AND APPARATUS FOR DIAGNOSING FUEL VAPOR CONTROL APPARATUS, AND METHOD AND APPARATUS FOR CONTROLLING AIR-FUEL RATIO

(75) Inventors: Masayuki Saruwatari; Junichi Furuya, both of Atsugi (JP)

(73) Assignee: Unisia Jecs Corporation, Kanagawa-Ken (JP)

( * ) Notice: Subject to any disclaimer, the term of this patent is extended or adjusted under 35 U.S.C. 154(b) by 0 days.

(21) Appl. No.: 09/527,231

(22) Filed: Mar. 16, 2000

(30) Foreign Application Priority Data

Mar. 19, 1999 (JP) ..... 11-076605
Mar. 19, 1999 (JP) ..... 11-076606

(51) Int. Cl.[7] ..... F02M 33/02
(52) U.S. Cl. ..... 123/520; 123/516
(58) Field of Search ..... 123/516, 518, 123/519, 520; 60/283, 285

(56) References Cited

U.S. PATENT DOCUMENTS 5,060,621 * 10/1991 Cook et al. ..... 123/520
5,103,794 * 4/1992 Shiraishi ..... 123/520
5,353,770 * 10/1994 Osanai et al. ..... 123/520

FOREIGN PATENT DOCUMENTS 6-159161 6/1994 (JP) .
7-189830 7/1995 (JP) .
11-182360 7/1999 (JP) .

* cited by examiner

*Primary Examiner*—Henry C. Yuen
*Assistant Examiner*—Mahmoud M Gimie
(74) *Attorney, Agent, or Firm*—McDermott, Will & Emery

(57) ABSTRACT

Purge control valves are mounted to purge pipings arranged in parallel for supplying purge gas from a canister to an engine. A flow rate of the purge control valve having a larger flow rate size is controlled in a step mode, and a flow rate equal to or smaller than a variation quantity in said step mode is controlled by the purge control valve having a smaller flow rate size.

13 Claims, 10 Drawing Sheets

METHOD AND APPARATUS FOR CONTROLLING FUEL VAPOR, METHOD AND APPARATUS FOR DIAGNOSING FUEL VAPOR CONTROL APPARATUS, AND METHOD AND APPARATUS FOR CONTROLLING AIR-FUEL RATIO

FIELD OF THE INVENTION

The present invention relates to a method and apparatus for controlling fuel vapor, a method and apparatus for diagnosing a fuel vapor control apparatus, and a method and apparatus for controlling an air-fuel ratio. Particularly, the present invention relates to a technique for controlling the fuel vapor, a technique for diagnosing the fuel vapor control apparatus, and a technique for controlling the air-fuel ratio accompanying the fuel vapor control, of an engine mounted on a vehicle.

DESCRIPTION OF THE RELATED ART

Conventionally, there has been known a fuel vapor control apparatus which comprises a canister with an adsorbent of an activated carbon or the like for adsorbing and collecting evaporation gas generated in a fuel tank of a vehicle, a purge piping for supplying purged air from the canister to an intake air system of the engine utilizing the intake negative pressure of the engine, and a purge control valve mounted on the purge piping for controlling a purge flow rate, for controlling the opening of a purge control valve based on a target purge flow rate set according to the operating conditions of the engine (refer for example to Japanese Patent Application Unexamined Publication No. 11-182360).

In order to treat a large quantity of evaporation gas adsorbed to the canister, the opening area of the purge control valve in its fully opened state must be large, and for this purpose, the purge control valve must have a large size. However, there occurred a problem that a large-sized valve generally has a low resolution for flow rate control, and therefore, the control accuracy of the purge flow rate is deteriorated.

Further, there is a need to diagnose whether the purge control valve is malfunctioning or not, however, in the conventional constitution wherein a pressure sensor is mounted for detecting the pressure inside the purge piping for diagnosis, the pressure sensor to be used only for diagnosis is needed. Therefore, the conventional diagnosis system was expensive.

Moreover, if the evaporation gas is supplied from the canister to the engine, it means that excessive fuel is supplied with respect to a new air quantity. Therefore, the air-fuel ratio is shifted to a rich side. In order to solve this problem, conventionally, a correction is made to the fuel injection quantity so as to restrain the air-fuel ratio from being shifted to a rich side by the supply of evaporation gas during purge, and released such correction when the purge is ceased.

However, the supply of evaporation gas to the engine is not cut off immediately after closing the purge control valve, but evaporation gas is still being supplied to the engine, though the amount thereof gradually being reduced even after the purge control valve has been closed. Therefore, conventionally, even if an air-fuel ratio feedback control is being performed, there is a possibility that the air-fuel ratio is greatly and transitionally varied immediately after closing the purge control valve, which resulted in problems such as torque fluctuation or emission deterioration.

SUMMARY OF THE INVENTION

The present invention aims to solve the above-mentioned problems. The object of the invention is to provide a fuel vapor control apparatus and control method which enables to control a purge flow rate with high accuracy while enabling to treat a large quantity of evaporation gas.

Further object of the present invention is to provide a diagnosis apparatus and diagnosis method of a fuel vapor control apparatus that is capable of diagnosing malfunction of purge control valves without using a pressure sensor.

Moreover, the object of the invention is to provide an air-fuel ratio control apparatus and control method that enables to restrain a transitional fluctuation of the air-fuel ratio when ceasing the purge.

In order to achieve the above objects, the present invention comprises a pair of purge pipings arranged in parallel, and purge control valves having different flow rate sizes mounted to said pair of purge pipings respectively, wherein a flow rate of the purge control valve having a larger flow rate size is varied in a step mode, and a flow rate of the smaller purge control valve is controlled to be equal to or smaller than the flow rate varied in the step mode, so as to control the flow rate to a target flow rate. Thereby, a large flow rate control is enabled while securing accurate control of the flow rate.

Further, the invention comprises a pair of purge pipings arranged in parallel, and purge control valves mounted to the pair of purge pipings, respectively, wherein, when the target purge flow rate is equal to or below a threshold value, the flow rate is controlled by opening only one purge control valve, and when the target purge flow rate exceeds the threshold value, the opening of the purge control valve which has been open controlled is fixed, and the other purge control valve which has been close controlled is opened. Thereby the flow rate which could not be obtained by controlling the one purge control valve to a fully-opened position is compensated for by performing the open control of the other purge control valve.

Here, in a constitution where two purge control valves are equipped and the ratio of opening time for each purge control valve is controlled, the opening timing of the two valves may be mutually diverged so as to restrain pulsation of the purge flow rate.

Moreover, in a system equipped with two purge control valves, an air-fuel ratio obtained when open controlling one valve to a reference opening area and an airfuel ratio obtained when open controlling the other valve to a reference opening area are compared with each other. When deviation of the air-fuel ratios exceeds a reference value, it is determined that either of the two valves is not controlled to the reference opening area, and a malfunction determination signal is output.

Moreover, when a malfunction is determined by the above diagnosis, the two purge control valves are both controlled to a fully-closed position, and an air-fuel ratio during such state is detected. The detected air-fuel ratio is compared with the air-fuel ratio obtained when open controlling the valves to the reference opening area, in order to determine whether each of the purge control valves is actually opened equivalent to the reference opening area. Even further, when it is judged that each of the purge control valves is not opened equivalent to the reference opening area, determination is made on whether the valve is fixed to have a smaller opening area than the reference opening area (close-fixed state), or whether the valve is fixed to have a larger opening area than the reference opening area (open-fixed state).

On the other hand, the fluctuation of the air-fuel ratio directly after ceasing the purge is restrained by correcting a fuel quantity to be supplied to the engine based on estimation of an evaporation gas quantity to be supplied to the engine after ceasing the purge.

The evaporation gas quantity to be supplied to the engine after ceasing the purge may be estimated as characteristics varying with time. Even further, a reference model of the varying characteristics of the quantity may be equipped to estimate the evaporation gas quantity provided that the evaporation gas to be supplied to the engine varies following the reference model.

Other objects and aspects of the present invention will become apparent in the following description explaining the embodiments of the present invention with reference to the accompanied drawings.

DETAILED DESCRIPTION OF THE PREFERRED EMBODIMENT

Figure 1:
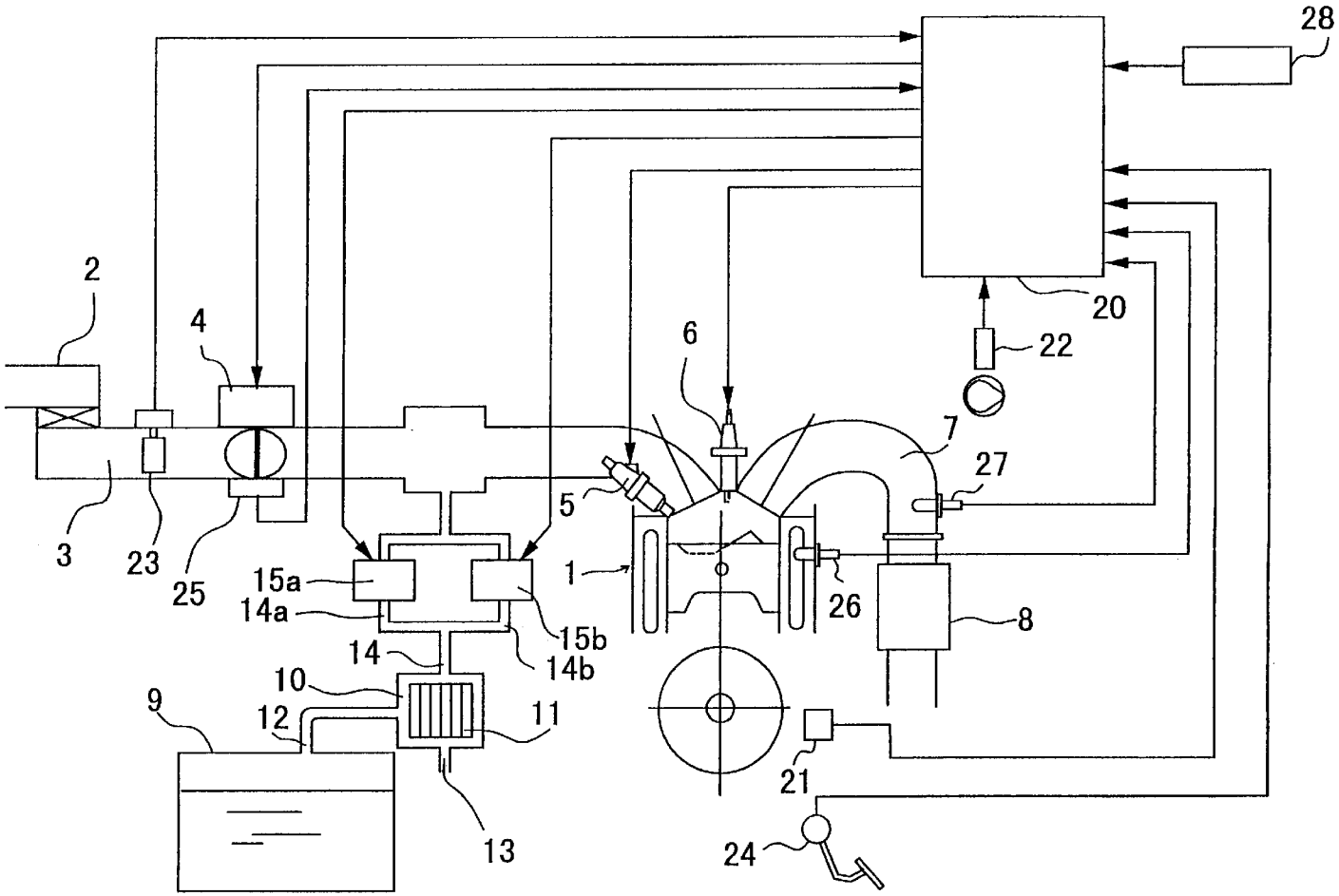
FIG. 1 shows a system configuration of an engine according to an embodiment of the present invention.

FIG. 1 is a system configuration diagram of an engine according to the present embodiment.

According to FIG. 1, air is sucked in via an air cleaner 2, an intake pipe 3 and an electronically controlled throttle valve 4 to a combustion chamber equipped to each cylinder of an engine 1 mounted on a vehicle.

An electromagnetic fuel injection valve 5 is equipped for directly injecting fuel (gasoline) into the combustion chamber of each cylinder.

The fuel injection valve 5 is opened by an injection pulse signal output from a control unit 20 during either an intake stroke or a compression stroke, to inject fuel adjusted to a predetermined pressure. In the case of intake stroke injection, the injected fuel is diffused within the combustion chamber to form a homogeneous mixture, and in the case of compression stroke injection, the injected fuel forms a stratified mixture concentrating around an ignition plug 6. A spark ignition of the fuel is performed by the ignition plug 6, so that the fuel is spark ignited by the ignition plug 6 to be combusted.

The combustion method may be categorized, in combination with an air-fuel ratio control, to the following categories; a homogeneous stoichiometric combustion, a homogeneous lean combustion (with an air-fuel ratio of 20 to 30), and a stratified lean combustion (with an air-fuel ratio of around 40).

However, the engine 1 is not limited to a direct injection type gasoline engine as mentioned above, but it may be an engine where the fuel is injected to an intake port.

Exhaust from the engine 1 is discharged through an exhaust pipe 7. A catalytic converter 8 for purifying the exhaust is equipped to the exhaust pipe 7.

Further, a fuel vapor control apparatus for combusting an evaporation gas generated in a fuel tank 9 by the engine is equipped.

A canister 10 constituting the fuel vapor control apparatus is formed by filling a sealing container with an adsorbent 11 such as an activated carbon. An evaporation gas inlet pipe 12 from the fuel tank 9 is connected to the canister 10. Accordingly, the evaporation gas generated in the fuel tank 9, during engine stop for example, travels through the evaporation gas inlet pipe 12, and is introduced to the canister 10 and adhered thereto.

A new air inlet opening 13 is formed to the canister 10, and a purge piping 14 extends out from the canister 10. The purge piping 14 is branched on the way thereof into two purge pipings 14*a* and 14*b*, which are combined again before being connected to the intake pipe 3 at the downstream side of the throttle valve 4 (intake manifold).

Purge control valves 15*a* and 15*b* are mounted to the two parallel purge pipings 14*a* and 14*b*, respectively, the valves being duty-controlled of their opening time ratios by control signals from the control unit 20.

In the above-mentioned arrangement, when the purge control valves 15*a* and 15*b* are open controlled, intake negative pressure of the engine 1 acts on the canister 10. As a result, the evaporation gas adsorbed by the adsorbent 11 of the canister 10 is purged by air introduced through the new air inlet opening 13. The purged air including the desorbed evaporation gas is sucked into to the intake pipe 3 at the downstream side of the throttle valve 4 through the purge pipings 14*a* and 14*b*, and is then combusted within the combustion chamber of the engine 1.

The control unit 20 is equipped with a microcomputer including a CPU, a ROM, a RAM, an A/D converter, an input/output interface and the like. The control unit 20 receives input signals from various sensors, and performs a calculation process based on the input signals, so as to control the operation of the fuel injection valve 5, the ignition plug 6, the purge control valves 15*a*, 15*b* and the like.

Various sensors include a crank angle sensor 21 for detecting the rotation of a crank shaft of the engine 1, and a cam sensor 22 for detecting the rotation of a cam shaft. When the number of cylinders is n, the sensors 21 and 22 output reference pulse signals REF, for every crank angle 720°/n, at a predetermined crank angle position (for example, 110° before compression top dead center). Further, the sensors output unit pulse signals POS for every 1 to 20°. The engine rotation number Ne (rpm) may be calculated from the cycle of the reference pulse signals REF and the like.

Other sensors equipped to the engine include an airflow meter 23 for detecting an intake airflow quantity Qa in the intake pipe 3 at the upstream side of the throttle valve 4, an accelerator sensor 24 for detecting a step-in quantity of the accelerator pedal (accelerator opening) APS, a throttle sensor 25 for detecting throttle valve opening TVO, a water temperature sensor 26 for detecting cooling water temperature Tw of the engine 1, an oxygen sensor 27 for outputting a signal corresponding to the rich/lean of an exhaust air-fuel ratio in the exhaust pipe 7, a vehicle speed sensor 28 for detecting a vehicle speed VSP and the like.

Further, the construction is such that air-fuel ratio feedback control for setting an air-fuel ratio feedback coefficient for correcting the fuel injection quantity in order to equalize the exhaust air-fuel ratio detected by the air-fuel ratio sensor 27 to a target air-fuel ratio is performed under a predetermined air-fuel ratio feedback condition. The purging of the evaporation gas from the canister 10 is performed on the condition that the air-fuel ratio feedback control is performed.

Next, the purge control performed by the control unit 20 is explained in detail.

Figure 2:
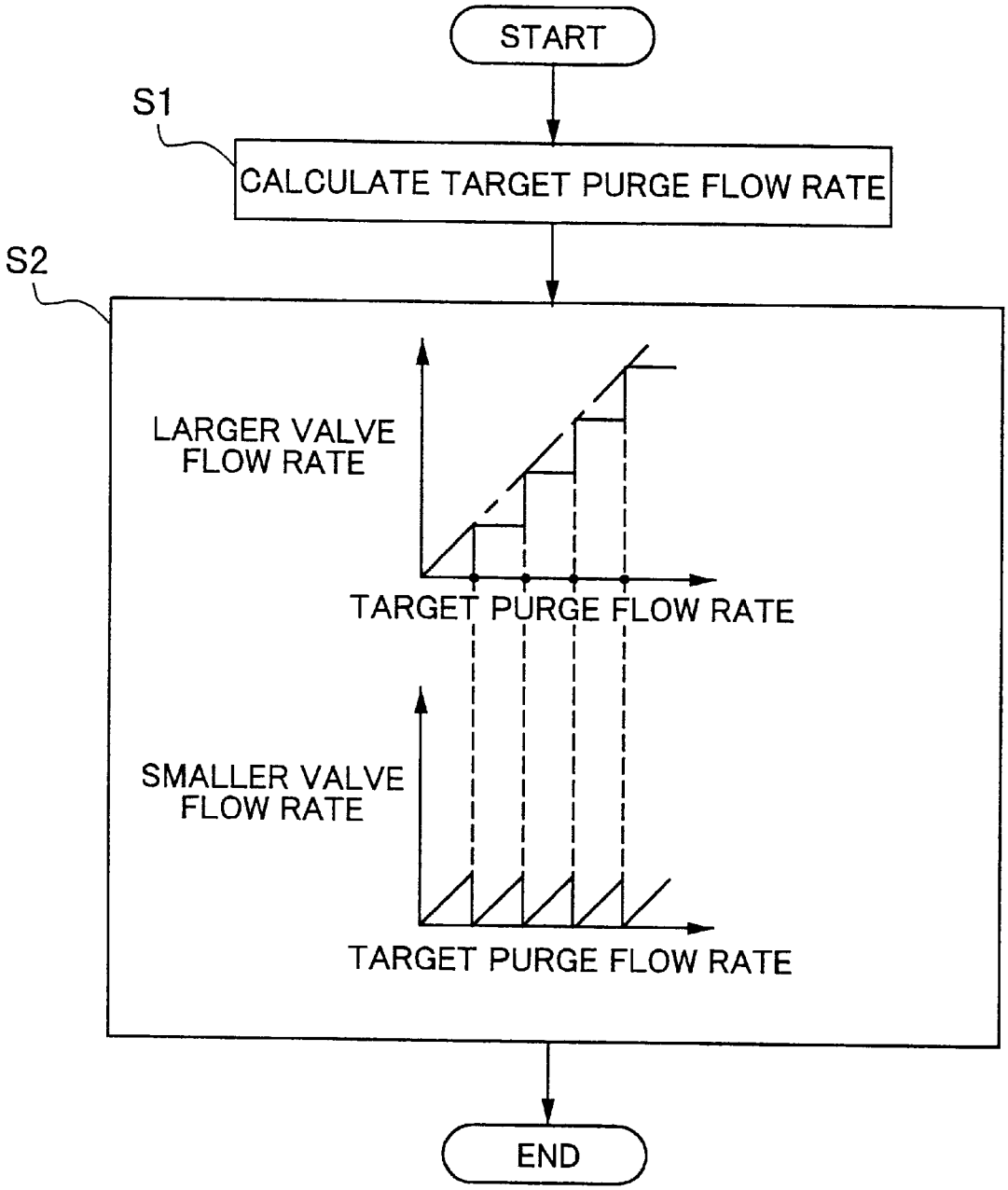
FIG. 2 is a flowchart showing a first embodiment of purge control.

The flowchart of FIG. 2 shows a first embodiment of the purge control. In the first embodiment, of the two purge control valves 15*a* and 15*b*, the purge control valve 15*a* is made to be larger than the purge control valve 15*b*.

According to the flowchart of FIG. 2, in step S1, a target purge flow rate is calculated. In particular, the target purge flow rate is calculated based on the engine rotation speed, the intake air quantity, the throttle opening and the like.

In step S2 which corresponds to a flow control device or flow control means, a purge flow rate for each of the two purge control valves 15*a* and 15*b* is determined according to the target purge flow rate.

Since the purge control valve 15*a* is large and the resolution thereof is relatively low, the flow rate (control duty) is set to be varied in a step mode to the target purge flow rate. In step S2, a maximum flow rate that may be controlled by the purge control valve 15*a* equal to or below the target purge flow rate at that time is calculated based on the above characteristics, to be set as a purge flow rate in the purge control valve 15*a*.

A control signal of a duty ratio corresponding to the set flow rate is output to the purge control valve 15*a*.

On the other hand, the purge control valve 15*b* is relatively small in size and the resolution thereof is relatively high. Therefore, a flow rate of the purge control valve 15*b* is determined so as to supply via the purge passage 14*b* a flow rate corresponding to deviation between the target purge flow rate and the flow rate controlled by the purge control valve 15*a*. The control signal of the duty ratio corresponding to the set flow rate is output to the purge control valve 15*b*.

In other words, the difference in the purge flow rate of the purge control valve 15*a* which varies in a step mode is smoothly connected by the flow control performed by the purge control valve 15*b*.

According to the above arrangement, by utilizing the large-size purge control valve 15*a*, a large quantity of evaporation gas may be treated, and at the same time, by utilizing the small-size purge control valve 15*b* mounted in parallel to the purge control valve 15*a*, the purge flow rate may be controlled with high accuracy.

Figure 3:
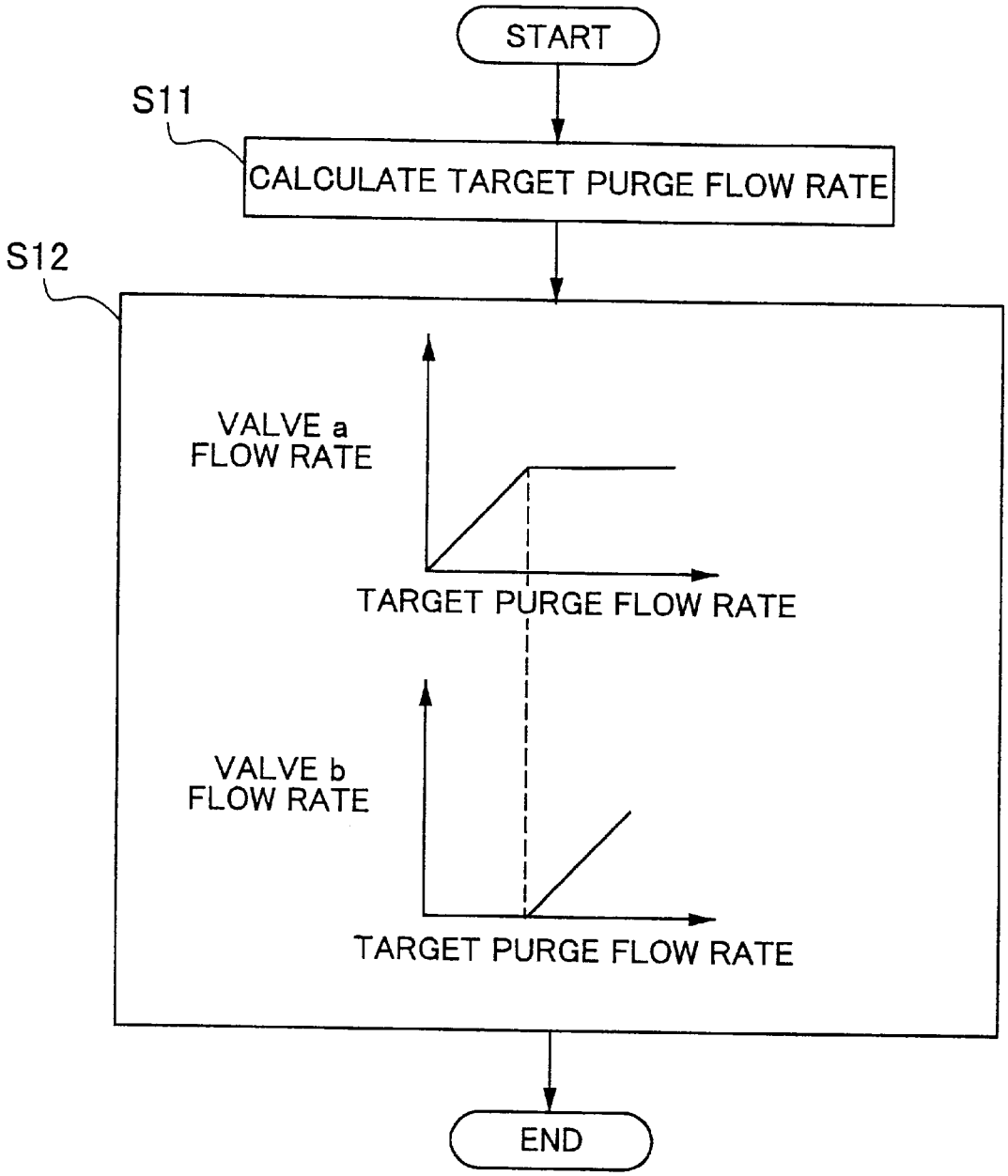
FIG. 3 is a flowchart showing a second embodiment of purge control.

The flowchart of FIG. 3 shows a second embodiment of purge control. In the second embodiment, the two purge control valves 15*a* and 15*b* have the same sizes.

According to the flowchart of FIG. 3, in step S11, a target purge flow rate is calculated similar to step S1.

In step S12 which corresponds to a flow control device or a flow control means, a flow rate for each of the two purge control valves 15*a* and 15*b* is determined according to the target purge flow rate.

Actually, when the target purge flow rate is in a range from 0 to a purge flow rate obtained by fully opening one purge control valve, only the purge control valve 15*a* is open controlled to obtain the target purge flow rate while maintaining the purge control valve 15*b* in a fully-closed position. When the target purge flow rate is larger than a flow rate obtained by open controlling the purge control valve 15*a* to a fully-opened position (threshold value), then the opening of the purge control valve 15*b* which has been controlled to a fully-closed position is open controlled, to increase the purge flow rate. Thereby, the target purge flow rate may be obtained.

According to the above structure, a maximum purge flow rate is obtained when the two purge control valves 15*a* and 15*b* are both fully opened. Therefore, even if the size of the two purge control valves 15*a* and 15*b* is relatively small, a large purge flow rate may be obtained. Moreover, the target purge flow rate is divided into a low flow rate region and a high flow rate region, and only the opening (opening area) of either one of the two purge control valves 15*a* and 15*b* is varied for each flow rate region. This is advantageous in that the flow rate control is performed by the resolution of each of the purge control valves 15*a* and 15*b*, and if the purge control valves 15*a* and 15*b* have the same size and the same level of resolution, the purge flow rate may be controlled with the same level of resolution throughout the whole region.

If the plurality of purge control valves 15 are simultaneously controlled by duty control to an intermediate opening, as in the first embodiment, it is preferred that phases at the opening timing for the purge control valves are controlled to be mutually diverged. More preferably, the phases by opening control of the purge control valves should be of opposite phase (flow control device).

If the phases at the opening timing for the plurality of purge control valves 15 are the same, the plurality of purge control valves 15 are to be open/close controlled simultaneously, and the purge flow rate will pulsate greatly. In contrast, when the phases at the opening timing for the respective purge control valves are mutually diverged, the fluctuation in flow rate may be restrained, and the flow rate of the purge sucked into each cylinder become unified.

In a fuel vapor treating apparatus explained above where a plurality of purge passages are arranged in parallel and a purge control valve is mounted to each purge passage, the malfunction of a purge control valve may be diagnosed as explained below.

Figure 4:
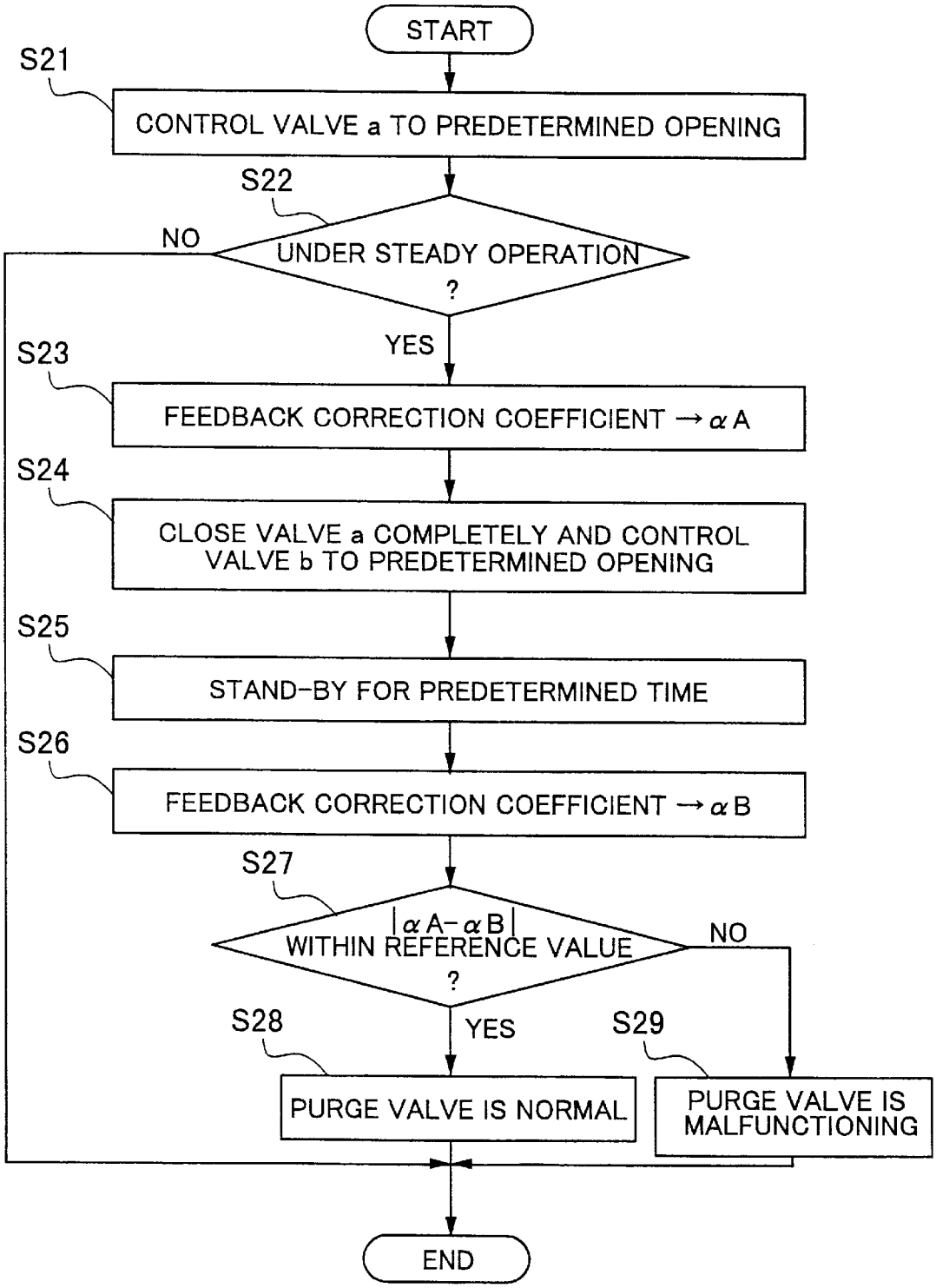
FIG. 4 is a flowchart for diagnosing the malfunction of a purge control valve.

FIG. 4 is a flowchart showing the diagnosis of malfunction of the valve. In the drawing, two purge passages 14*a* and 14*b* are arranged in parallel, and purge control valves 15*a* and 15*b* having the same sizes are mounted to each passage.

In step S21 which corresponds to a control device for diagnosis or control means for diagnosis, only the purge control valve 15*a* is controlled to a predetermined opening (reference opening area), in preference to a request of a target purge flow rate at that time.

In step S22, determination is made on whether the engine is in a steady operating condition or not.

When the engine is in a steady operating condition, the procedure is advanced to step S23, which corresponds to an air-fuel ratio detecting device or air-fuel ratio detecting means. In step S23, an air-fuel ratio feedback coefficient set at the airfuel ratio feedback control is stored as a value $\alpha A$ corresponding to a base air-fuel ratio obtained when only the purge control valve 15*a* is controlled to the predetermined opening.

The base air-fuel ratio indicates an air-fuel ratio obtained without any correction by the air-fuel ratio feedback coefficient.

Next, in step S24 which together with step S21 constitutes the control device for diagnosis or control means for diagnosis, the purge control valve 15*a* is fully-closed, and instead, the purge control valve 15*b* is controlled to the same opening (same opening area: reference opening area), that is, the predetermined opening.

In step S25, the purge control valve 15*b* is set to a stand-by state until a lapse of predetermined time after being opened. After said predetermined time has passed, the procedure is advanced to step S26.

In step S26 which corresponds to the air-fuel ratio detecting device or air-fuel ratio detecting means, the air-fuel ratio feedback coefficient during the opened state of the purge control valve 15*b* is stored as a value αB corresponding to a base air-fuel ratio obtained when the purge control valve 15*b* is controlled to the predetermined opening.

In step S27 which corresponds to a malfunction diagnosis device or malfunction diagnosis means, determination is made on whether an absolute value of deviation between values αA and αB is equal to or below a reference value.

The stored values αA and αB are values taken by controlling the purge control valves 15*a* and 15*b* respectively to the same opening (opening area). Therefore, when the purge control valves 15*a* and 15*b* are actually controlled to the same opening, the values should be approximately the same.

On the other hand, when for example, the purge control valve 15*a* is at a close-fixed state (the state where the valve cannot be moved from the closed state), the purge control valve 15*a* maintains a closed state even when the valve is open controlled. At such a state, no evaporation gas is supplied to the engine. On the other hand, when the purge control valve 15*b* is open controlled to be actually opened and evaporation gas is supplied to the engine, the air-fuel ratio of the engine is shifted to a rich side. Therefore, in order to inhibit the air-fuel ratio from being shifted to a rich side, the fuel quantity is decreasingly corrected by the air-fuel ratio feedback control, so that deviation occurs between values αA and αB.

Therefore, if it is determined in step S27 that the absolute value of deviation between values αA and αB is equal to or below the reference value, it is judged that the purge control valves 15*a* and 15*b* are not malfunctioning. The procedure is advanced to step S28, where a normality determination signal of the purge control valves is output. On the other hand, if it is determined in step S27 that the absolute value of deviation between values αA and αB exceeds the reference value, it is judged that either of the purge control valves 15*a* or 15*b* is malfunctioning, and the procedure is advanced to step S29, where a malfunction determination signal of the purge control valve is output.

The constitution may be such that the purge control valves 15*a* and 15*b* are formed to have different sizes from each other. In such a case, the air-fuel ratio feedback coefficients obtained when the respective purge control valves 15*a* and 15*b* are opened to the same opening area (reference opening area) individually may be mutually compared.

The above diagnosis is capable of diagnosing the state where either the purge control valve 15*a* or the purge control valve 15*b* is malfunctioning, but it is not capable of specifying which of the two purge control valves is actually malfunctioning.

Figure 5:
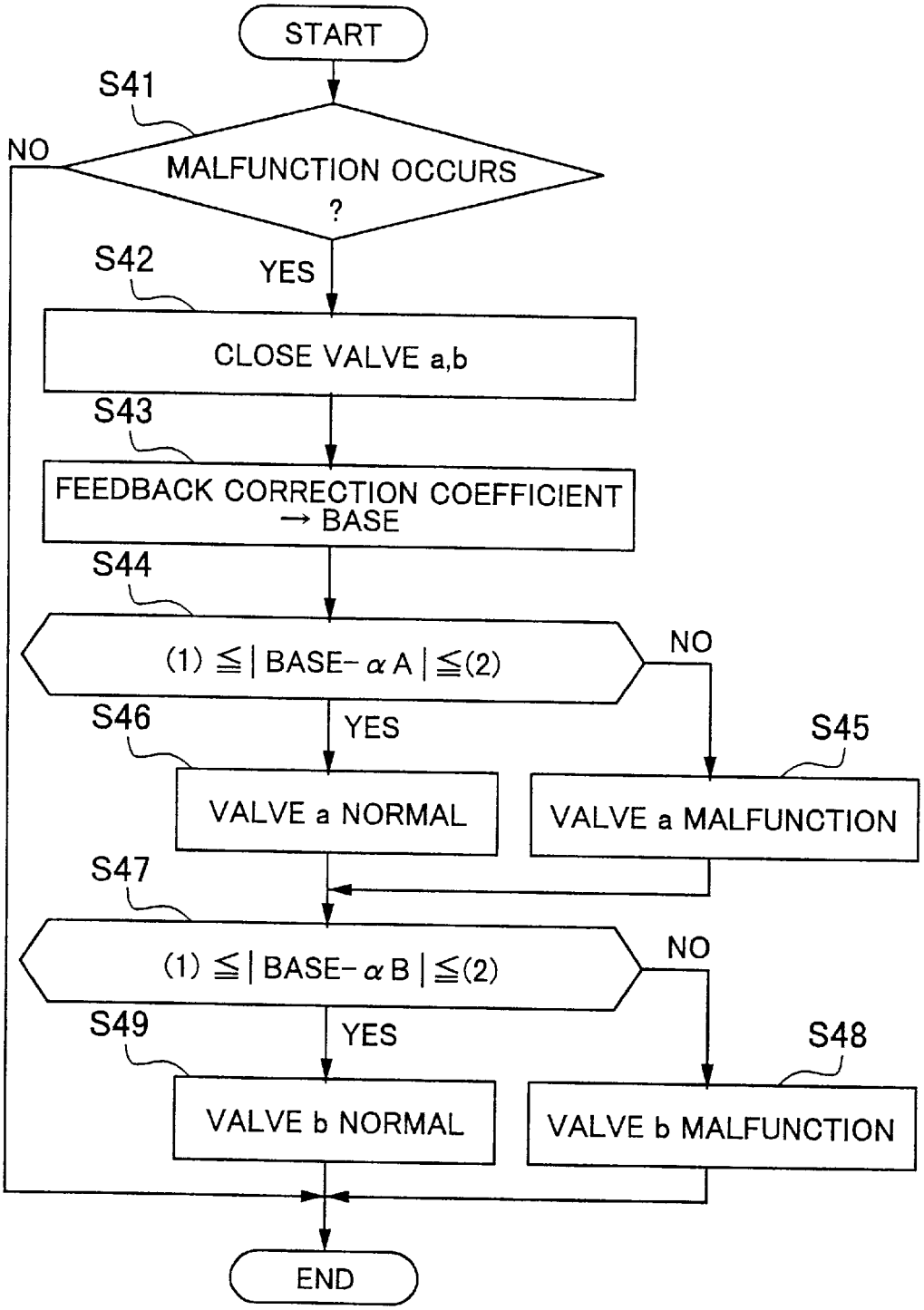
FIG. 5 is a flowchart showing a diagnosis for specifying the malfunctioning purge control valve.

Therefore, if it is diagnosed by the flowchart of FIG. 4 that either the purge control valve 15*a* or the purge control valve 15*b* is malfunctioning (when the malfunction determination signal is output), it is preferable to execute the flowchart of FIG. 5 continuously, which enables to specify the malfunctioning purge control valve.

In step S41, determination is made on whether the malfunction determination signal is output or not, which leads to determining whether either the purge control valve 15*a* or the purge control valve 15*b* is malfunctioning.

If a malfunction is diagnosed, the procedure is advanced to step S42, which corresponds to a full-close control device or full-close control means. In step S42, the purge control valves 15*a* and 15*b* are both forced to close completely. Thereby, the purge is stopped.

In step S43, the feedback correction coefficient during the state where the purge is stopped as above is set and stored as BASE, which is a value showing the base air-fuel ratio in such state.

In step S44 which corresponds to a first malfunctioning purge control valve determination device or first malfunctioning purge control valve determination means, determination is made on whether an absolute value of deviation between the BASE and αA which is the value of feedback correction coefficient when the purge control valve 15*a* is controlled to the predetermined opening, is equal to or above predetermined value 1 and equal to or under predetermined value 2 (within the reference range).

When the absolute value of the deviation between αA and the BASE is below the predetermined value 1, it means that although the purge control valve 15*a* is controlled to the predetermined opening, the actual purge flow rate was smaller than an expected purge flow rate. It is anticipated that the purge control valve 15*a* is in a fix-closed state. On the other hand, when the absolute value of the deviation between αA and the BASE is above the predetermined value 2, it means that the actual purge flow rate was greater than the expected purge flow rate. It is anticipated that the purge control valve 15*a* is in an open-fixed state (a state where the valve can not be moved from the fully opened state).

Therefore, when the absolute value of the deviation between αA and the BASE is not within the range equal to or above the predetermined value 1 and equal to or below the predetermined value 2, the procedure is advanced to step S45, where the malfunction determination signal of purge control valve 15*a* is output. When the absolute value of the deviation between αA and the BASE is within the above range (equal to or above the predetermined value 1 and equal to or below the predetermined value 2), the procedure is advanced to step S46 where the normality determination signal of the purge control valve 15*a* is output.

Figure 6:
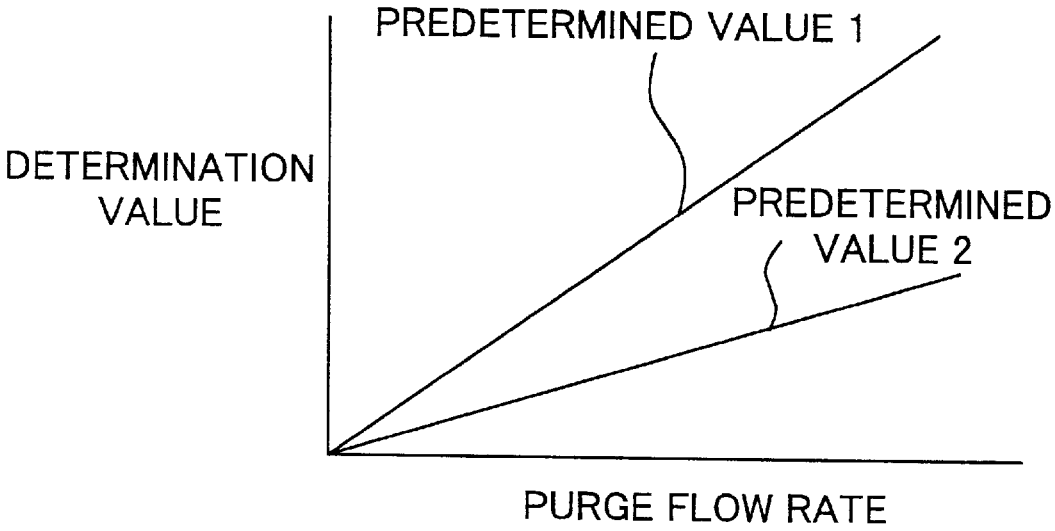
FIG. 6 is a chart showing characteristics of a determination value utilized to specify the malfunctioning purge control valve.

Further, as shown in FIG. 6, the predetermined values 1 and 2 may be set variably according to the purge flow rate.

Further, the constitution may be such that a close-fixed state determination signal of the purge control valve 15*a* may be output when the absolute value of the deviation between αA and the BASE is below the predetermined value 1, and an open-fixed state determination signal of the purge control valve 15*a* may be output when the absolute value of the deviation exceeds the predetermined value 2. Similarly, when diagnosing whether the purge control valve 15*b* is malfunctioning or not (which is explained in the following), the malfunctioning purge control valve may be determined as being either in a close-fixed state or an open-fixed state.

In step S47 which corresponds to a second malfunctioning purge control valve determination device or second malfunctioning purge control valve determination means, determination is made on whether an absolute value of deviation between the BASE and αB which is the value of feedback correction coefficient when the purge control valve 15*b* is controlled to the predetermined opening, is equal to or above the predetermined value 1 and equal to or below the predetermined value 2.

When the absolute value of the deviation between αB and the BASE is not within the range equal to or above the predetermined value 1 and equal to or below the predetermined value 2, the procedure is advanced to step S48, where the malfunction determination signal of purge control valve 15*b* is output. When the absolute value of the deviation between αB and the BASE is within the above range (equal to or above the predetermined value 1 and equal to or below the predetermined value 2), the procedure is advanced to step S49 where the normality determination signal of the purge control valve 15*b* is output.

Figure 7:
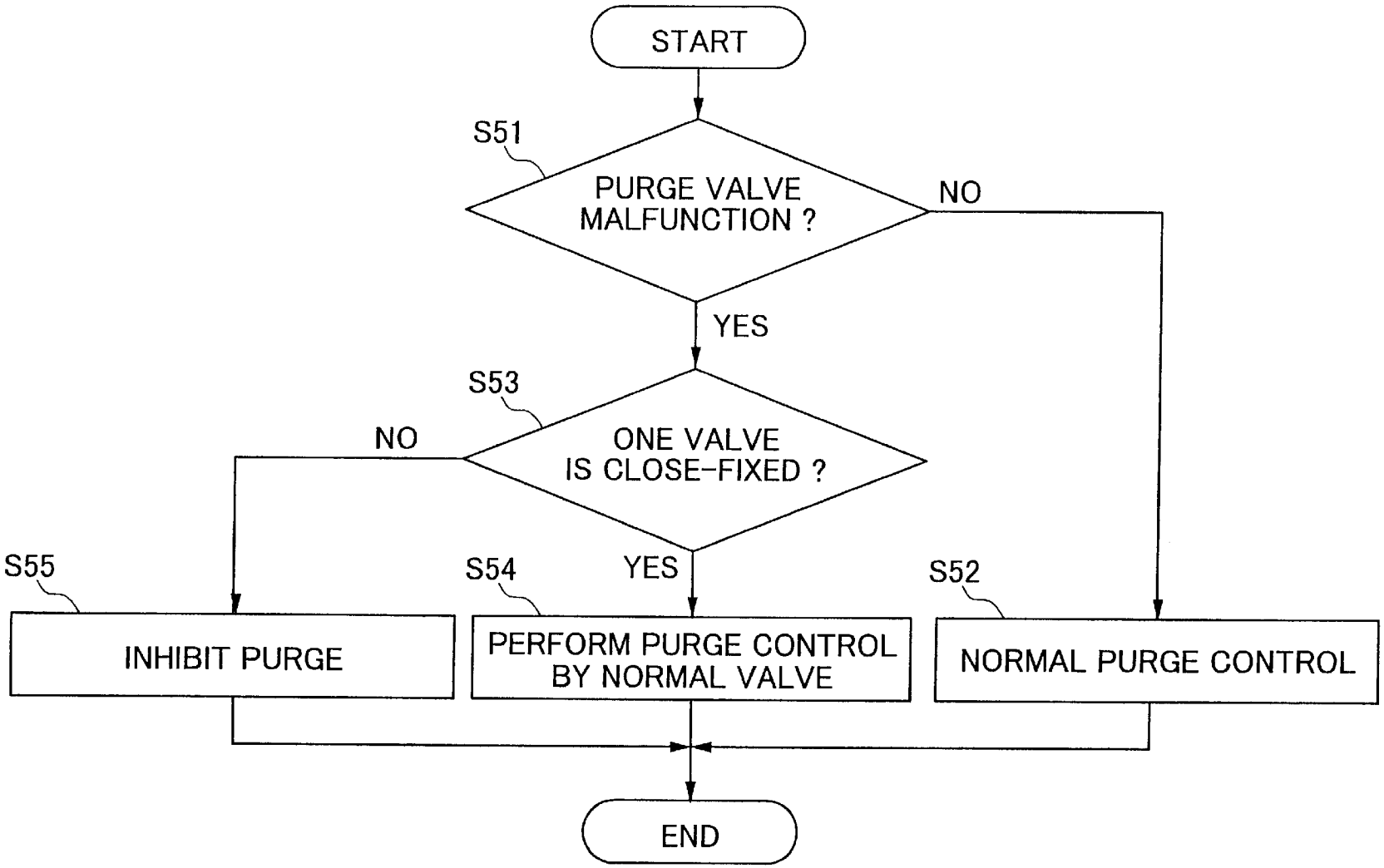
FIG. 7 is a flowchart showing a failsafe control performed when a malfunction occurs.

The flowchart of FIG. 7 shows a failsafe control performed after receiving the result of the above-mentioned malfunction determination. In step S51, it is determined whether either the purge control valve 15*a* or the purge control valve 15*b* is malfunctioning. When both of the purge control valves 15*a* and 15*b* are not malfunctioning, the procedure is advanced to step S52, where a normal purge control is carried out.

On the other hand, when either the purge control valve 15*a* or the purge control valve 15*b* is malfunctioning, the procedure is advanced to step S53, where determination is made on whether the malfunction state of the purge control valve 15*a* or the purge control valve 15*b* is a close-fixed state or not.

If either the purge control valve 15*a* or the purge control valve 15*b* is malfunctioning and the malfunction state thereof is a close-fixed state, the procedure is advanced to step S54, which corresponds to a malfunctioning-state flow control device or malfunctioning-state flow control means. In step S54, only the purge control valve that is not malfunctioning controls the purge quantity.

For example, in a system controlling the purge quantity to a target purge quantity as shown in FIG. 2, when the smaller purge control valve is in a close-fixed state, the purge flow may be controlled by utilizing only the larger purge control valve although the resolution of the larger purge control valve is low. Further, in a system equipped with a plurality of purge control valves having the same sizes, the purge flow may be controlled in approximately half the maximum flow region.

On the other hand, when either the purge-control valve 15*a* or the purge control 15*b* is malfunctioning and the malfunction state thereof is a open-fixed state, the procedure is advanced to step S55, which corresponds to a flow control inhibiting device or flow control inhibiting means. In step S55, the purge control is inhibited, and the purge control valves 15*a* and 15*b* are not open controlled.

The following explains an embodiment related to an the air-fuel ratio control.

Figure 8:
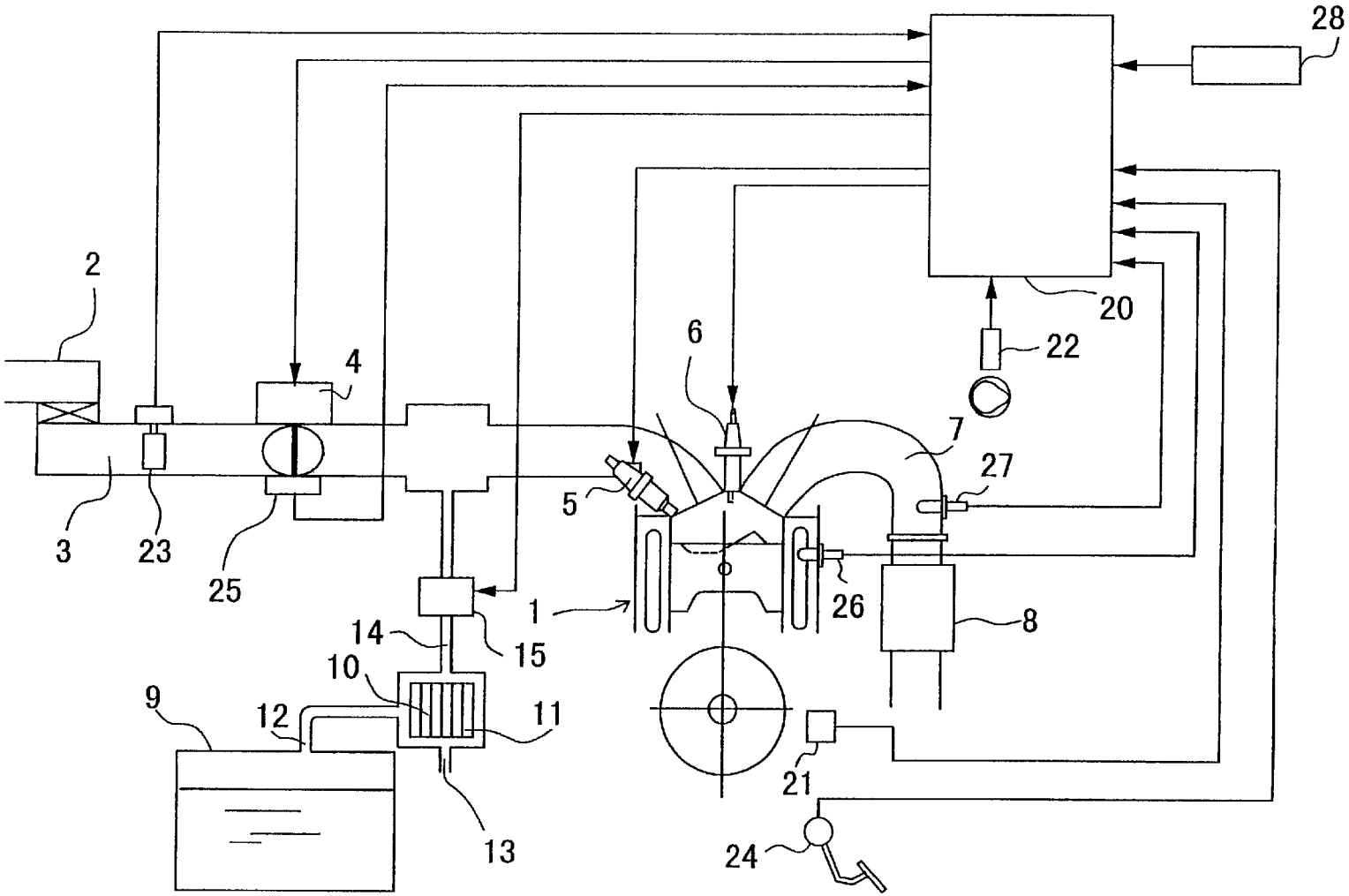
FIG. 8 is a system configuration of an engine to which an air-fuel ratio control of the present invention is applied.

FIG. 8 is a system configuration of the engine to which the air-fuel ratio control according to the present invention is applied. FIG. 8 corresponds to FIG. 1, but the system of FIG. 8 differs from FIG. I in that it has only one purge piping system 14 equipped with a purge control valve 15. Since the other constituents shown in FIG. 8 are the same as those shown in FIG. 1, detailed explanations thereof are omitted.

Next, the purge control and the air-fuel ratio control carried out by the control unit 20 shown in FIG. 8 are explained with reference to the flowchart of FIG. 9.

Figure 9:
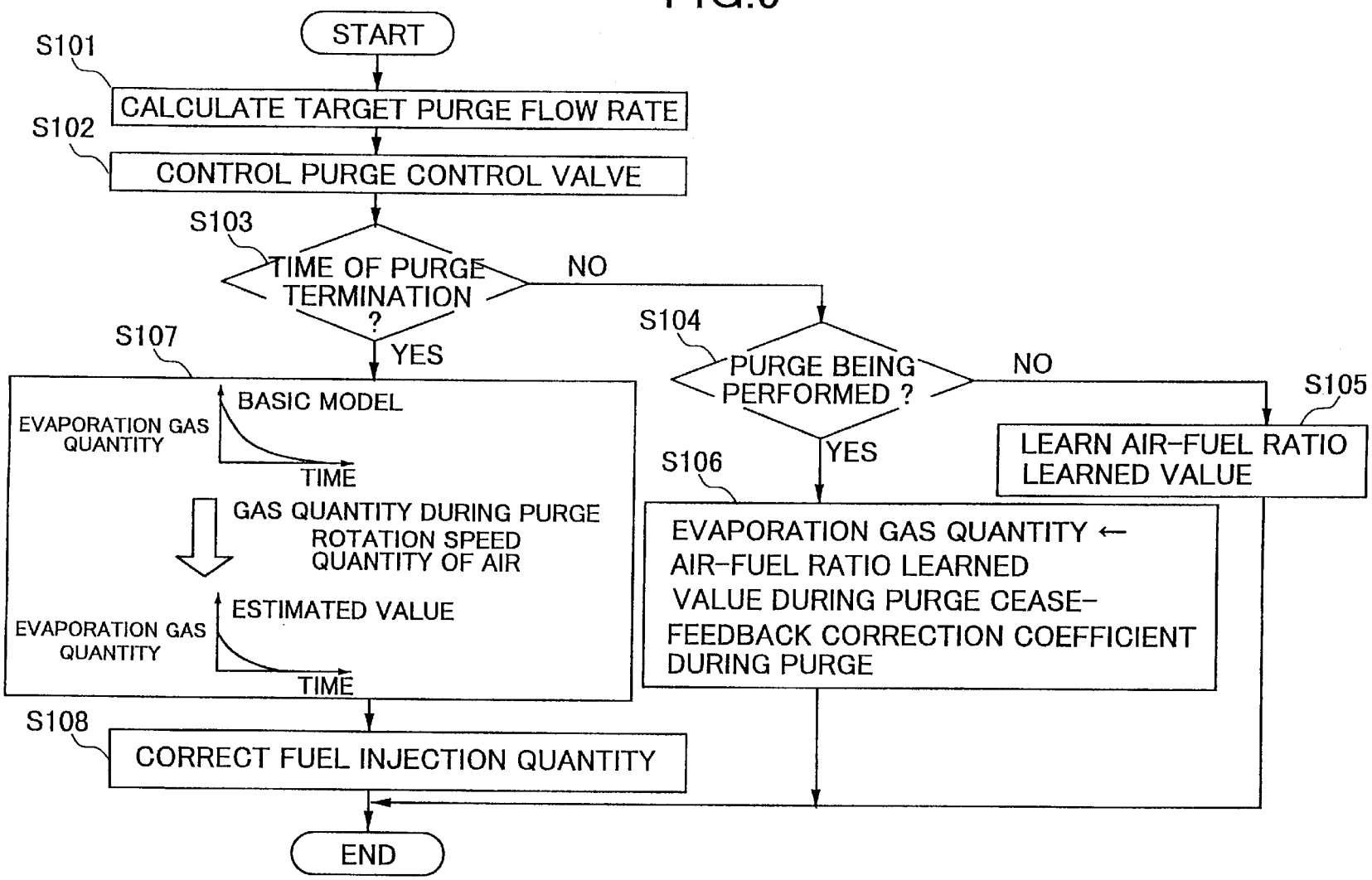
FIG. 9 is a flowchart showing a correction control of a fuel injection quantity immediately after ceasing the purge.

According to the flowchart of FIG. 9, in step S101, a target purge flow rate is calculated. In step S102, the purge control valve 15 is controlled according to the target purge flow rate. The calculation of the target purge flow rate includes judgement of the purge condition, and when it is judged that purge condition is not satisfied, the target purge flow rate is set to 0, and the purge is stopped.

In step S103, determination is made on whether it is time of purge termination or not. When it is not yet time of purge termination, the procedure is advanced to step S104. The time of purge termination means the period from when the purge is stopped to when the fuel correction (explained in the following) is terminated.

In step S104, determination is made on whether the purge is being performed or not. If the purge is not being performed, the procedure is advanced to step S105. In step S105, an air-fuel ratio feedback correction coefficient at that time is learned as an air-fuel ratio learned value, which corresponds to the relevant region of a map dividing the operating region to plural regions according to the load and rotation of the engine.

On the other hand, when it is determined in step S104 that the purge is being performed, the procedure is advanced to step S106. In step S106, deviation between the air-fuel ratio learned value of the relevant region learned during purge suspension and the air-fuel ratio feedback correction coefficient is calculated as a value showing the evaporation gas quantity at that time.

As above, after calculating the evaporation gas quantity while performing the purge, the purge control valve 15 is closed and the purge is ceased. Then, procedure is advanced from step S103 to step S107, where the evaporation gas quantity to be sucked into the engine after ceasing the purge is estimated.

Step S107 corresponds to an evaporation gas quantity estimation device or evaporation gas quantity estimation means.

Actually, a basic model is stored in advance, showing the change in evaporation gas quantity to be sucked into the engine according to the elapsed time from when the purge is ceased. Normally, the evaporation gas quantity to be sucked into the engine will be gradually reduced according to the characteristics of the basic model.

However, since dispersion exists in the purge concentration, the evaporation gas quantity with respect to the elapsed time in the basic model is shifted by the evaporation gas quantity calculated during purge.

Moreover, even if the evaporation gas quantity remaining in the intake system of the engine during ceasing of the purge is the same, the speed in which the evaporation gas is sucked into the engine differs according to the operating conditions of the engine. When the engine rotation speed is high and the load is great, the residual evaporation gas is combusted faster. Therefore, the time in the basic model is decreasingly corrected when the rotation speed is high and the load is great, and the characteristics is corrected so that the evaporation gas quantity is reduced faster when the rotation speed is high and the load is great.

After estimating the evaporation gas quantity to be sucked into the engine subsequent to terminating the purge, the procedure is advanced to step S108, where the fuel injection quantity is corrected according to the estimated evaporation gas quantity at that time.

The above-mentioned step S108 corresponds to a fuel quantity correction device or fuel quantity correction means.

Actually, a predetermined coefficient is multiplied to the evaporation gas quantity to be converted to a correction quantity. The correction quantity is subtracted from a basic fuel injection quantity, so as to reduce the portion of the evaporation gas to be sucked into the engine from the fuel quantity injected by the fuel injection valve 5.

If the correction of the fuel quantity in step S108 is performed appropriately, the air-fuel ratio should be stabilized in the vicinity of the target air-fuel ratio even immediately after ceasing the purge. However, due to the successive variation or the change with time of the engine, the accuracy of estimation of the evaporation gas quantity may be deteriorated. In such case, even if the fuel injection quantity is corrected based on the estimated evaporation gas quantity, the air-fuel ratio may be deviated from the target air-fuel ratio.

Figure 10:
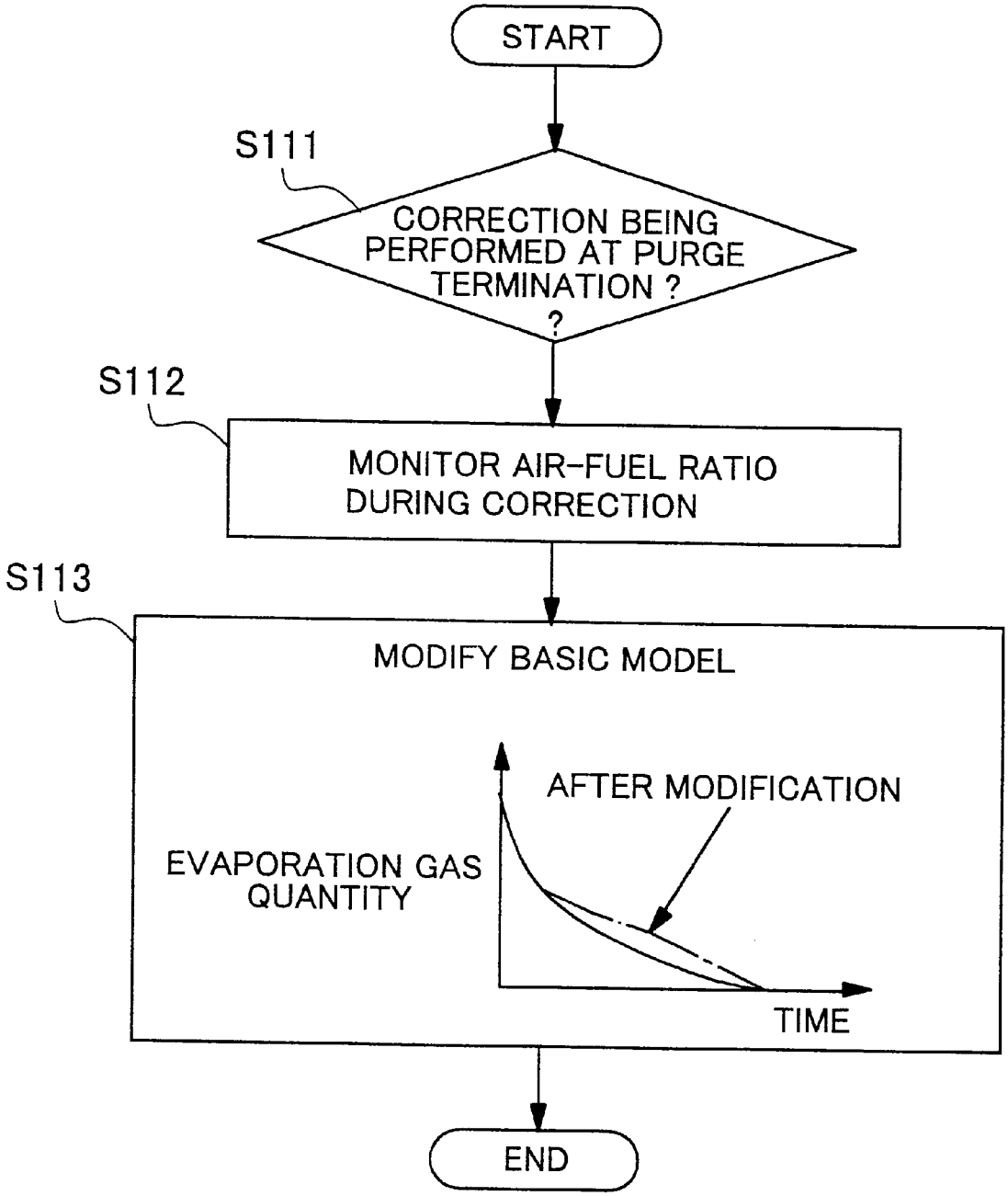
FIG. 10 is a flowchart showing a modification control of a basic model of the change in evaporation gas quantity.

Therefore, as shown in the flowchart of FIG. 10, the basic model is preferably modified according to the deviation of the air-fuel ratio.

According to the flowchart of FIG. 10, in step S111, determination is made on whether the fuel injection quantity is being corrected based on the estimated evaporation gas quantity. If it is determined that the quantity is being corrected, the procedure is advanced to step S112.

In step S112, the deviation of the actual air-fuel ratio from the target air-fuel ratio during correction of the fuel injection quantity based on the estimated evaporation gas quantity is monitored.

Then, in step S113 corresponding to a next basic model modification device, the evaporation gas quantity stored in the basic model corresponding to the time when there occurs deviation of the air-fuel ratio is rewritten by modifying the basic model so that the deviation of the air-fuel ratio is restrained. Therefore, from the next time, the evaporation gas quantity may be estimated according to the modified basic model.

What we claimed are:

1. A fuel vapor control apparatus for combusting fuel vapor generated in a fuel tank by an engine, comprising:

a canister for adsorbing and collecting fuel vapor generated in said fuel tank;

a pair of purge pipings arranged in parallel for supplying the fuel vapor from said canister to an intake system of the engine;

two purge control valves mounted to said pair of purge pipings respectively, said two purge control valves being different in flow rate size from each other; and a flow control device for controlling a purge flow rate to a target purge flow rate, by varying a flow rate of a purge control valve having the larger flow rate size in a step mode, and controlling a flow rate smaller than a variation quantity in the step mode, by the purge control valve having the smaller flow rate size.

2. A diagnosis apparatus for a fuel vapor control apparatus comprising:

a canister for adsorbing and collecting fuel vapor generated in a fuel tank;

a pair of purge pipings arranged in parallel for supplying the fuel vapor from said canister to an intake system of the engine;

two purge control valves mounted to said pair of purge pipings respectively; and a flow control device for controlling a purge flow rate to a target purge flow rate by controlling the openings of said two purge control valves respectively;

wherein said diagnosis apparatus comprises:

a control device for diagnosis which, in preference to said flow control device, controls one of said two purge control valves to a fully closed position while open controlling the other purge control valve to a reference opening area, and further controls said other purge control valve to a fully closed position while open controlling said one purge control valve to said reference opening area;

an air-fuel ratio detecting device for detecting an air-fuel ratio of the combustion mixture of said engine; and a malfunction diagnosis device for outputting a malfunction determination signal of said purge control valve when deviation between an air-fuel ratio detected when said one purge control valve is open controlled to the reference opening area and an air-fuel ratio detected when said other purge control valve is open controlled to the reference opening area exceeds a reference value.

3. The diagnosis apparatus for a fuel vapor control apparatus according to claim 2, comprising:

a full-close control device for controlling said two purge control valves to a fully closed position, in preference to said flow control device, when a malfunction determination signal is output from said malfunction diagnosis device;

a first malfunctioning purge control valve determination device for outputting a normality determination signal of said one purge control valve when the deviation between the air-fuel ratio detected when the two purge control valves are both controlled to a fully closed position by said fully-close control device and the air-fuel ratio detected when said one purge control valve is open controlled to the reference opening area is within a reference range, and on the other hand, outputting an abnormality determination signal of said one purge control valve when said deviation is not within said reference range; and a second malfunctioning purge control valve determination device for outputting a normality determination signal of said other purge control valve when the deviation between the air-fuel ratio detected when the two purge control valves are both controlled to a fully closed position by said fully-close control device and the air-fuel ratio detected when said other purge control valve is open controlled to the reference opening area is within a reference range, and on the other hand, outputting an abnormality determination signal of said other purge control valve when said deviation is not within said reference range.

4. The diagnosis apparatus for a fuel vapor control apparatus according to claim 3, wherein:

said first malfunctioning purge control valve determination device outputs an abnormality determination signal showing that said one purge control valve is in a close-fixed state when said deviation between the two air-fuel ratios is smaller than said reference range, and outputs an abnormality determination signal showing that said one purge control valve is in an open-fixed state when said deviation between the two air-fuel ratios is greater than said reference range; and said second malfunctioning purge control valve determination device outputs an abnormality determination signal showing that said other purge control valve is in a close-fixed state when said deviation between the two air-fuel ratios is smaller than the reference range, and outputs an abnormality determination signal showing that said other purge control valve is in an open-fixed state when said deviation between the two air-fuel ratios is greater than said reference range.

5. The diagnosis apparatus for a fuel vapor control apparatus according to claim 4, further comprising:

a flow control device during malfunction for controlling the purge flow rate by one purge control valve whose normality is determined, when it is determined by said first malfunctioning purge control valve determination device and said second malfunctioning purge control valve determination device that only one out of said two purge control valves is malfunctioning, and that said malfunction is a close-fixed malfunction; and a flow control inhibiting device for inhibiting the purge flow control by said two purge control valves when it is determined the occurrence of malfunction which is other than the malfunction in which the purge flow rate may be controlled by said flow control device during malfunction.

6. A diagnosis method for a fuel vapor control apparatus comprising:

a canister for adsorbing and collecting fuel vapor generated in a fuel tank;

a pair of purge pipings arranged in parallel for supplying the fuel vapor from said canister to an intake system of the engine; and two purge control valves mounted to said pair of purge pipings respectively;

said diagnosis method comprising the steps of:

open controlling only either one of said two purge control valves to a reference opening area;

detecting an air-fuel ratio of a combustion mixture of the engine at that time;

calculating deviation between the detected air-fuel ratio value when one purge control valve is controlled to said reference opening area and the detected air-fuel ratio value detected when the other purge control valve is controlled to said reference opening area; and outputting a malfunction determination signal of said purge control valve when said deviation exceeds a reference value.

7. The diagnosis method for a fuel vapor control apparatus according to claim 6, further comprising the steps of:

controlling said two purge control valves to a fully-closed position when outputting said malfunction determination signal;

detecting the air-fuel ratio of the combustion mixture of the engine at that time; and determining a malfunctioning purge control valve based on the deviation between the detected air-fuel ratio value when the two purge control valves are both controlled to a fully-closed position and the detected air-fuel ratio value when only one of said two valves is open controlled to the reference opening area.

8. The diagnosis method for a fuel vapor control apparatus according to claim 7, wherein:

said step of determining a malfunctioning purge control valve determines a malfunctioning purge control valve and determines whether the malfunction is a close-fixed state or an open-fixed state based on the deviation between the detected air-fuel ratio value when the two purge control valves are both controlled to a fully-closed position and the detected air-fuel ratio value when only one of said two valves is open controlled to the reference opening area.

9. A fuel vapor control method for combusting fuel vapor generated in a fuel tank by an engine comprising:

a canister for adsorbing and collecting fuel vapor generated in said fuel tank;

a pair of purge pipings arranged in parallel for supplying the fuel vapor from said canister to an intake system of the engine; and two purge control valves mounted to said pair of purge pipings respectively, said two purge control valves being different in flow rate size from each other;

wherein said control method comprises the steps of:

calculating a target purge flow rate;

controlling a flow rate of the purge control valve having the larger flow rate size of the two purge control valves in a step mode according to said target purge flow rate; and controlling a flow rate of the purge control valve having a smaller flow rate size of the two purge control valves to a flow rate corresponding to a difference between the target purge flow rate and the flow rate of said purge control valve having the larger flow rate size.

10. A diagnosis apparatus for a fuel vapor control apparatus comprising:

a canister for adsorbing and collecting fuel vapor generated in a fuel tank;

a pair of purge pipings arranged in parallel for supplying the fuel vapor from said canister to an intake system of the engine;

two purge control valves mounted to said pair of purge pipings respectively; and a flow control means for controlling a purge flow rate to a target purge flow rate by controlling the openings of said two purge control valves respectively;

wherein said diagnosis apparatus comprises:

a control means for diagnosis which, in preference to said flow control means, controls one of said two purge control valves to a fully closed position while open controlling the other purge control valve to a reference opening area, and further controls said other valve to a fully closed position while open controlling said one purge control valve to a reference opening area;

an air-fuel ratio detecting means for detecting an air-fuel ratio of a combustion mixture of said engine; and a malfunction diagnosis means for outputting a malfunction determination signal of said purge control valves when deviation between an air-fuel ratio detected when said one purge control valve is open controlled to the reference opening area and an air-fuel ratio detected when said other purge control valve is open controlled to the reference opening area exceeds a reference value.

11. The diagnosis apparatus for a fuel vapor control apparatus according to claim 10, comprising:

a full-close control means for controlling said two purge control valves to a fully closed position, in preference to said flow control means, when the malfunction determination signal is output from said malfunction diagnosis means;

a first malfunctioning purge control valve determination means for outputting a normality determination signal of said one purge control valve when the deviation between the air-fuel ratio detected when the two purge control valves are both controlled to a fully closed position by said fully-close control means and the air-fuel ratio detected when said one purge control valve is open controlled to the reference opening area is within a reference range, and on the other hand, outputting an abnormality determination signal of said one purge control valve when said deviation is not within said reference range; and a second malfunctioning purge control valve determination means for outputting a normality determination signal of said other purge control valve when the deviation between the air-fuel ratio detected when the two purge control valves are both controlled to a fully closed position by said fully-close control means and the air-fuel ratio detected when said other purge control valve is open controlled to the reference opening area is within said reference range, and on the other hand, outputting an abnormality determination signal of said other purge control valve when said deviation is not within said reference range.

12. The diagnosis apparatus for a fuel vapor control apparatus according to claim 11, wherein:

said first malfunctioning purge control valve determination means outputs an abnormality determination signal showing that said one purge control valve is in a close-fixed state when said deviation between the two air-fuel ratios is smaller than said reference range, and outputs an abnormality determination signal showing that said one purge control valve is in an open-fixed state when said deviation between the two air-fuel ratios is greater than said reference range; and said second malfunctioning purge control valve determination means outputs an abnormality determination signal showing that said other purge control valve is in a close-fixed state when said deviation between the two air-fuel ratios is smaller than the reference range, and outputs an abnormality determination signal showing that said other purge control valve is in an open-fixed state when said deviation between the two air-fuel ratios is greater than said reference range.

13. The diagnosis apparatus for a fuel vapor control apparatus according to claim 12, further comprising:

a flow control means during malfunction for controlling the purge flow rate by one purge control valve whose normality is determined, when it is determined by said first malfunctioning purge control valve determination means and said second malfunctioning purge control valve determination means that only one out of said two purge control valves is malfunctioning, and that said malfunction is a close-fixed malfunction; and a flow control inhibiting means for inhibiting the purge flow rate control by said two purge control valves when it is determined the occurrence of malfunction which is other than the malfunction in which the purge flow rate may be controlled by said flow control means during malfunction.

* * * * *